US009282826B1

(12) United States Patent
Hickman

(10) Patent No.: US 9,282,826 B1
(45) Date of Patent: Mar. 15, 2016

(54) ERGONOMIC CHAIR AND SYSTEM

(71) Applicant: Clever Concepts, LLC, Milford, MA (US)

(72) Inventor: Tara Hickman, Milford, MA (US)

(73) Assignee: CLEVER CONCEPTS, LLC, Milford, MA (US)

( * ) Notice: Subject to any disclaimer, the term of this patent is extended or adjusted under 35 U.S.C. 154(b) by 0 days.

(21) Appl. No.: 13/754,933

(22) Filed: Jan. 31, 2013

Related U.S. Application Data

(60) Provisional application No. 61/593,364, filed on Feb. 1, 2012.

(51) Int. Cl.
*A47C 7/62* (2006.01)
*A47C 7/72* (2006.01)

(52) U.S. Cl.
CPC .... *A47C 7/72* (2013.01); *A47C 7/62* (2013.01)

(58) Field of Classification Search
CPC ..... A47C 7/54; A47C 7/62; A47C 7/72
USPC ..... 297/161, 188.14, 188.15, 217.3, 297/411.35, 411.36, 411.37, 411.38
See application file for complete search history.

(56) References Cited

U.S. PATENT DOCUMENTS

| | | | | |
|---|---|---|---|---|
| 4,661,005 | A | 4/1987 | Lahr | |
| 4,822,103 | A | 4/1989 | Stenvall | |
| 5,135,190 | A | 8/1992 | Wilson | |
| 5,311,210 | A * | 5/1994 | O'Brien et al. | 345/168 |
| 5,536,070 | A * | 7/1996 | Lemmen | 297/411.37 |
| 5,612,718 | A * | 3/1997 | Bryan | 345/168 |
| 5,655,814 | A * | 8/1997 | Gibbs | 297/411.38 |
| 5,892,499 | A | 4/1999 | Vulk, Jr. | |
| 6,003,940 | A * | 12/1999 | Jackson | 297/217.3 |
| 6,005,496 | A | 12/1999 | Hargreaves et al. | |
| 6,084,576 | A | 7/2000 | Leu et al. | |
| 6,237,997 | B1 * | 5/2001 | Olson | 297/162 |
| 6,273,502 | B1 | 8/2001 | Lo | |
| 6,540,300 | B2 | 4/2003 | Piretti | |
| 6,592,085 | B2 | 7/2003 | Iwata et al. | |
| 6,702,373 | B2 * | 3/2004 | Rossko | 297/173 |
| 6,773,071 | B1 * | 8/2004 | Stasney et al. | 297/411.27 |
| 6,860,661 | B1 | 3/2005 | Daoud | |
| 7,182,533 | B1 | 2/2007 | Caplan | |
| 7,324,019 | B2 | 1/2008 | Levenson | |
| 7,520,689 | B2 | 4/2009 | Lane | |
| 7,862,111 | B2 * | 1/2011 | Steenson | 297/161 |

* cited by examiner

*Primary Examiner* — Philip Gabler
(74) *Attorney, Agent, or Firm* — Kriegsman & Kriegsman

(57) ABSTRACT

Ergonomic chairs, systems and hand and arm support structures capable of comfortably supporting upper arms, forearms, back, seat, and hand heels of a user are provided. Devices and device holders designed for ergonomic benefit to be utilized in conjunction with the chairs, systems, and support structures are also disclosed. Device holders feature a platform and a hand heel rest. Actuator components of a number of the devices are disposed on a multidimensionally arcuate surface.

12 Claims, 10 Drawing Sheets

ERGONOMIC CHAIR AND SYSTEM

CROSS-REFERENCE TO RELATED APPLICATION(S)

This application claims the benefit of U.S. Provisional Patent Application Ser. No. 61/593,364, filed Feb. 1, 2012, which is incorporated herein by reference.

BACKGROUND ART

Suffering, discomfort, injury and potential long-term disability caused by the necessarily repetitive motion involved with data input, typing, computer interfacing, and electronic gaming remains widespread. Numerous solutions have been proposed and devices/methods have been patented that partially address specific aspects of the repetitive strain problem. There remains a need for a synergistic, ergonomic solution that neither requires learning new skills nor requires discarding skills already mastered such as, for example, touch typing with a standard QWERTY-type keyboard.

SUMMARY OF THE INVENTION

A first embodiment provides an ergonomic chair capable of comfortably supporting upper arms, forearms, back, seat, and hand heels of a user. The chair features a left upper arm support, a right upper arm support, a back support, a left forearm support, a right forearm support, a chair seat, a left device holder and a right device holder. The left forearm support has a left forearm rest and an adjustable left forearm aligner; the right forearm support has a right forearm rest and an adjustable right forearm aligner. The left device holder is capable of being attached to the chair seat and is adjustable for user comfort with respect to a position of the adjustable left forearm aligner; the right device holder is also capable of being attached to the chair seat and is adjustable with respect to a position of the adjustable right forearm aligner. Each device holder has a platform and a hand heel rest.

In another embodiment, an ergonomic system is provided. In combination with the ergonomic chair embodiment described above, the system has a left device capable of being attached to the left device holder of the chair. In another embodiment, in combination with the ergonomic chair embodiment described above, the system has a right device capable of being attached to the right device holder of the chair. In a further embodiment, the system may include both a left device and a right device. This further embodiment may have a left device having alphanumeric actuators disposed in left hand rows. The left hand rows defining a left hand QWERTY pattern, the left device positionable so that when the user's arms, forearms, back, seat, and hand heels are supported, and when the user's left hand heel contacts the left hand heel rest, the left hand actuators are reachable by user left hand digit ends. The system may have a right device having alphanumeric actuators disposed in right hand rows. The right hand rows defining a right hand QWERTY pattern, the right device positionable so that when the user's arms, forearms, back, seat, and hand heels are supported, and when the user's right hand heel contacts the right hand heel rest, the right hand actuators are reachable by user right hand digit ends. The ergonomic system may have a tablet holder as the left and/or right device.

In other embodiments, the chair may include a frame capable of coupling the chair seat to the back support. At least one of the left device holder and the right device holder may have a thumb rest; the thumb rest(s) may have an actuator. At least one of the left device holder and the right device holder may have a palm rest.

In yet other embodiments, the actuators intended to be actuatable by long finger ends may be recessed with respect to other actuators in a row. The actuators intended to be actuatable by little finger ends may be raised with respect to other actuators in a row. A further embodiment features a multidimensionally arcuate surface on which the actuators are disposed.

An ergonomic hand and arm support structure capable of comfortably supporting an upper arm, a forearm, and a hand heel of a user is provided as another embodiment. The support structure is attachable to a chair that has a back support and a chair seat. The support structure has an upper arm support, a forearm support having a forearm rest and an adjustable forearm aligner, and a device holder, adjustable with respect to a position of the adjustable forearm aligner. The device holder has a platform and a hand heel rest. The device holder may also have a thumb rest; the thumb rest may have an actuator. The device holder may have a palm rest. In another embodiment, an ergonomic system has at least one ergonomic hand and arm support structure described above. The system also has at least one device capable of being attached to the device holder of the at least one support structure.

DETAILED DESCRIPTION OF EXEMPLARY EMBODIMENTS

Figure 1:
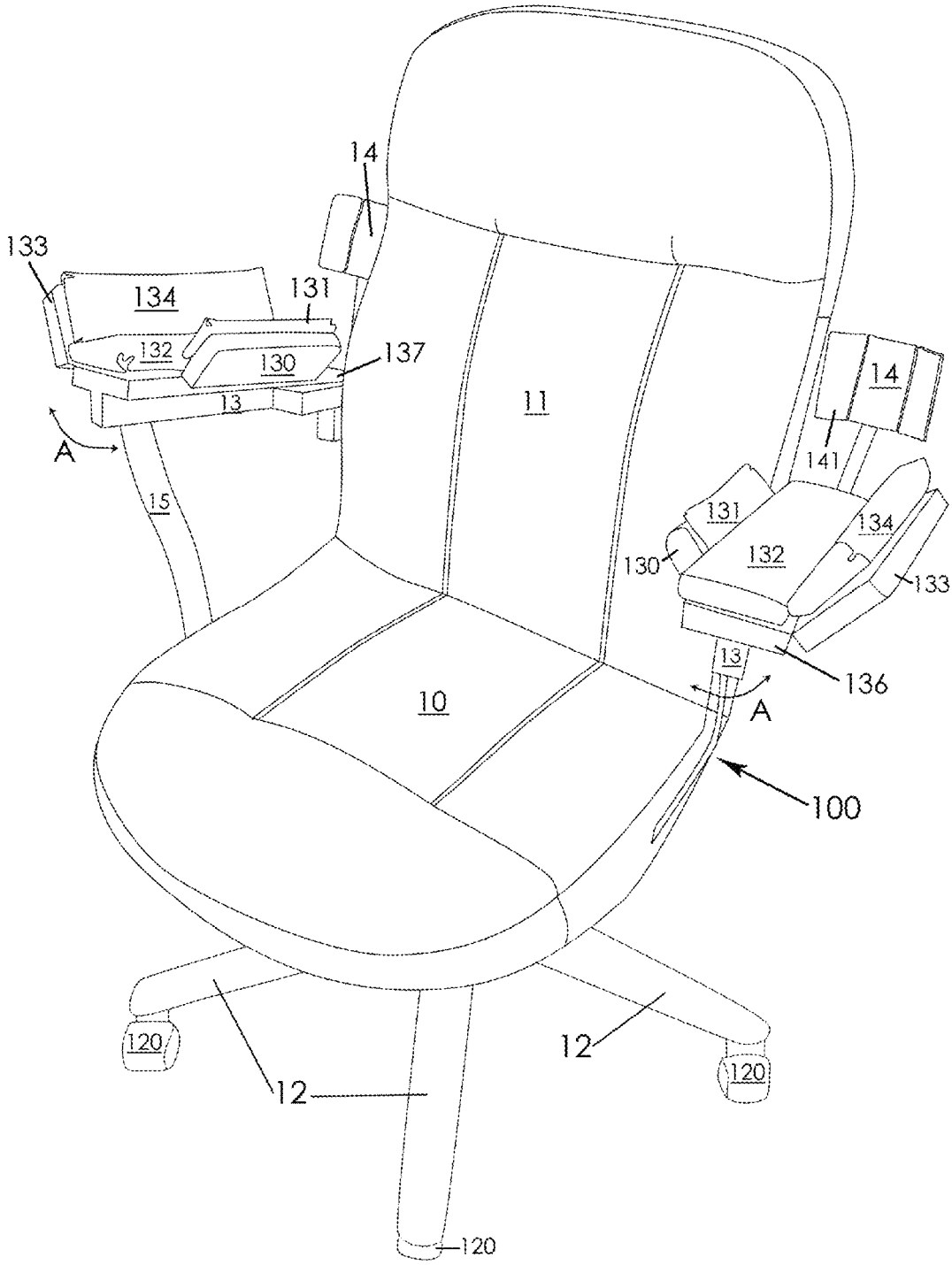
FIG. 1 illustrates an ergonomic chair in accordance with an embodiment.

Referring to FIG. 1, ergonomic chair 100 is shown with chair seat 10, back support 11, and legs 12. (Note that although legs 12 are shown with associated rolling casters 120, ergonomic chair 100 design is in no way limited to that of a rolling office chair design.) Many chairs feature a mechanism (not shown) to facilitate tilting of chair seat 10 and associated back support 11 allowing a user to comfortably recline while seated. Incorporation of such a mechanism into the embodiments of ergonomic chair 100 described herein, while not required, may be beneficial in achieving desired ergonomic goals. Chair 100 could (not shown) also have a head and/or a foot rest. Chair 100 might also (not shown) have shelves, pockets or other enclosures to store other system parts or equipment. Chair 100 may also be an integrated part of a docking station or part of a complete workstation or port replicator. Within the spirit of the present disclosure, chairs of many designs other than the depicted rolling office chair may be outfitted with the elements described below and are to be considered a part of this disclosure.

Figure 2:
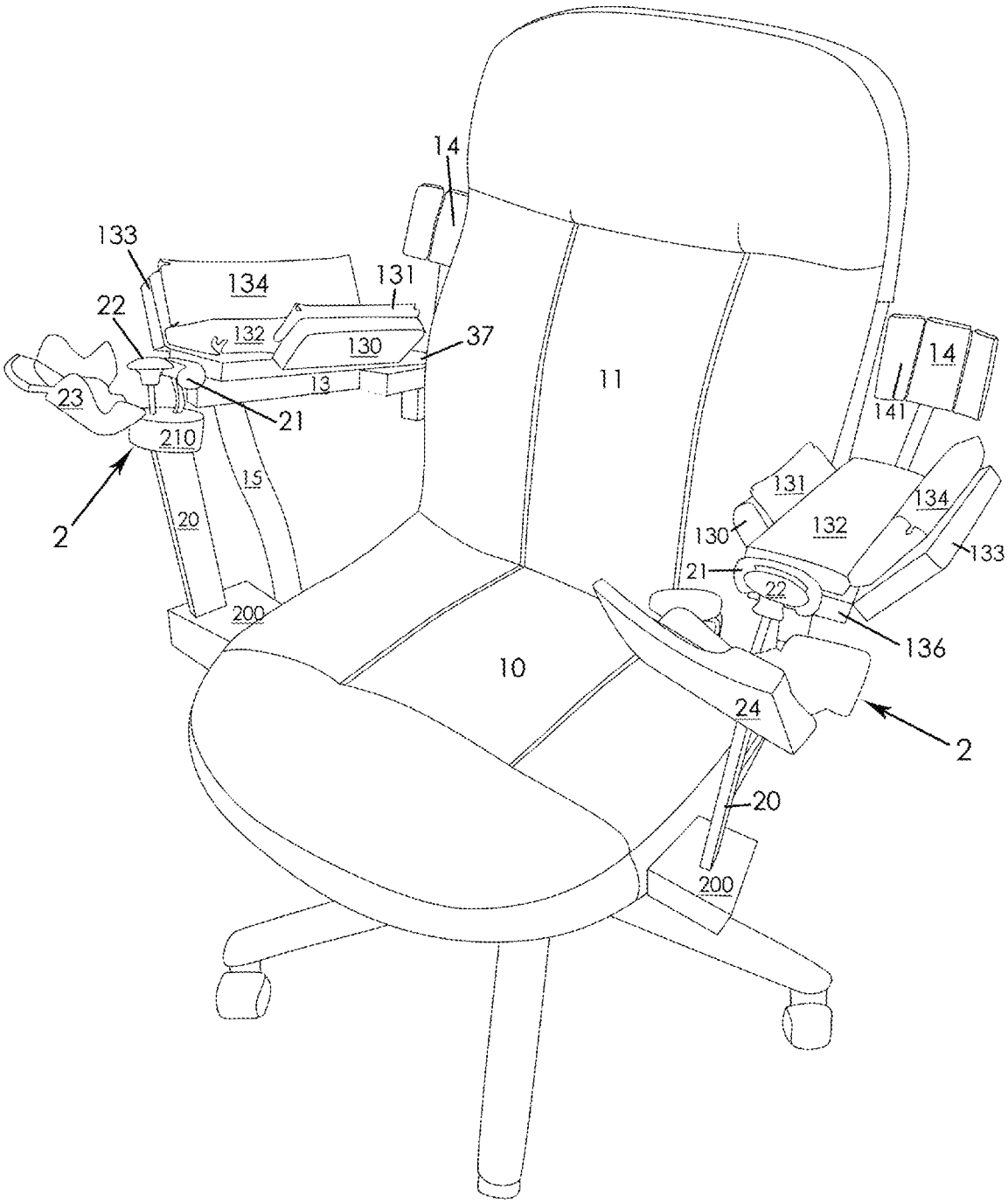
FIG. 2 illustrates an ergonomic system including an ergonomic chair with hand supports, device holders and generic devices in accordance with an embodiment.
Figure 3:
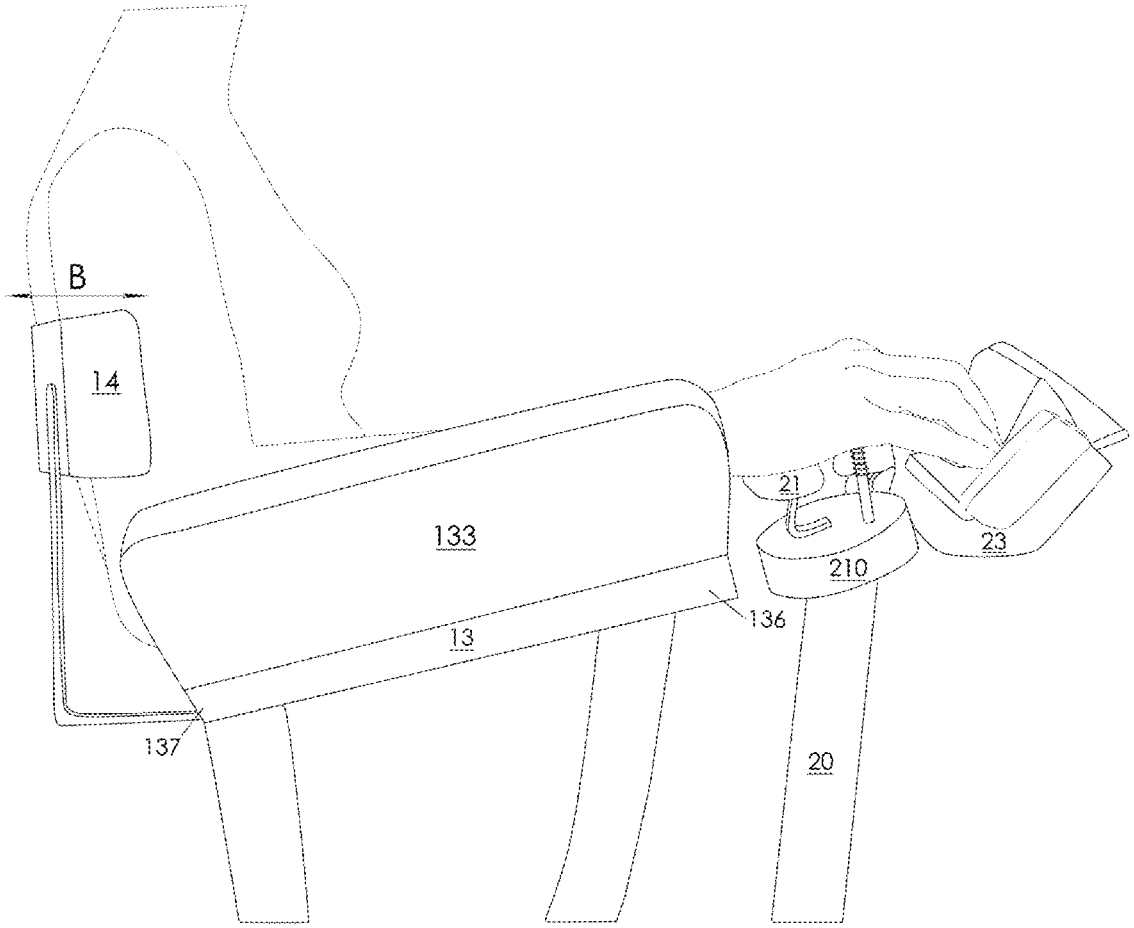
FIG. 3 is a side view of an arm support, hand support, and key pad in a further embodiment.

It is intended that chair 100 comfortably accommodate a user to sit bringing the torso fully back into chair 100 thereby greatly reducing upper body, arm and neck stress and increasing relaxation. To further reduce stress, it is foundational that in all of the ergonomic chair and system embodiments, the weight of a user's arms be fully supported while typing or performing other tasks when seated and/or reclined in chair 100. Referring now to FIGS. 1-3, a pair of forearm support bases 13 and associated upper arm supports 14 are provided as elements of chair 100. Each forearm support base 13 is illustrated attached to chair seat 10 by brace 15 and directly attached to an edge of back support 11. A design variation, given that chair seat 10 and back support 11 will beneficially be fabricated from soft materials, might include rigid essentially L-shaped chair frame(s) (not shown). Such frame(s) would be attachable to portions of the edges of chair seat 10 and to back support 11, as is known in the art. Forearm support bases 13 and upper arm supports 14 may then be affixed to these rigid frame(s). Forearm support bases 13 are elongate having a wrist end 136 and an elbow end 137. To enhance the relaxation and comfort of the user, forearm support bases 13 may be inclined relative to chair seat 10 and to the surface upon which chair 100 sits such that elbow end 137 is closer to the surface ("lower" as the typical surface would be a floor) than is wrist end 136. As a natural result, when a user sits, bringing the torso fully back with a relatively elevated wrist and lowered elbow, more complete contact of the user's upper arms with upper arm supports 14 is facilitated leading to increased arm and associated muscle relaxation akin to that achievable in a recliner. Inclination of forearm support bases 13 might be accomplished by making brace 15 adjustable in length or by other methods known in this art. For illustrative purposes only, height off the floor/surface for elbow ends 137 may be about 25" while height off the floor/surface for wrist ends 136 may be 27½". Upper arm supports 14 are shown having a central portion and two side portions configured to provide added lateral stabilization to the upper arms of a supported user. Other designs for supports 14, including a single component support having straight or curved "sides" are to be considered within the scope. The position of upper arm supports 14 may also be movable forward and back (along B) to suit the particular needs of the user. Note that upper arm support 14 is configured with its lower edge 141 located above, relative to the floor/surface, the position of a user's elbow allowing movement of the elbow joint during use. Brace 15 is illustrated as attaching forearm support base 13 with chair seat 10 (or, alternatively, to rigid frame not shown) proximal to wrist end 136 for increased stability. Mechanical couplings to facilitate the desired ergonomic/comfort results described above may be of any type known to those of skill in the art. Adjustable forearm alignment is shown to be accomplished by providing sides to the forearm rest/support base 13. Inner side 130, inner side cushion 131, rest cushion 132, outer side 133, and outer side cushion 134 are shown forming an effective cradle for the forearm (cradle adjustable to accommodate variable forearm girth) of a supported user, thereby maximizing support, minimizing tension and ensuring appropriate forearm alignment. In this embodiment, both inner side 130 and cushion 131 are shorter in length than both outer side 133 and outer side cushion 134 providing a balance between constriction and comfort. For illustrative purpose only, forearm support base 13 may be 10½" long×3" wide; inner side 130 and inner side cushion 131 may be 6" long×2" wide; and outer side 133 and outer side cushion 134 may be 10" long×3" wide. In addition, each of the forearm support bases 13 may be made rotatable (using a pivoting mechanism known in the art) about axis A. See also FIGS. 6(*a*) and 6(*b*). This may be a useful feature to facilitate access and egress to chair 100 by the user. Whether bases 13 are further rotatable or not, ergonomics and comfort dictate that elbow ends 137 of bases 13 are, when the user is seated with supported torso, positioned closer to each other (the distance apart being a bit larger than the dimensional width of back support 11) than are wrist ends 136 of bases 13. For illustrative purposes, elbow ends 137 may be 21" apart, while wrist ends 136 may be as much as 24" apart or more.

Refer now to system FIG. 2 and FIG. 3. As described above, the location of upper arm support(s) 14 are adjustable so that when the supported user's upper arm(s) abut it (them) and the supported user's forearm(s) are cradled and supported on rest cushion(s) 132, both the user's palm(s) and, as shown, the heel(s) of the user's hand(s) may be comfortably supported upon device holder(s) 2. Each device holder 2 comprises support 20, hand heel rest 21, (Note: "hand heel" is a term of art referring to the part of a hand most proximal to/abutting the wrist of a user) and, convex-shaped (as shown, but no way limited in shape) palm rest 22. Support blocks 200 are shown attached to chair seat 10 (as discussed above, support blocks 200 might also be attached to a rigid chair frame (not shown)) to provide an extended lateral structural element to secure support 20 and, as a result, device holder 2 at an appropriate lateral position. In the figures, support 20 is shown to be of a set length; within the scope, support 20 may be designed to telescope, providing yet another adjustment to aid in user support and comfort. Such adjustment may be necessary depending upon the particulars of device holder(s) 2 as well as the particular device(s) to be held. Support 20 may also be directly attached to forearm base 13 and/or brace 15. Right device holder 2 is designed to rigidly hold a right hand device 23 upon an incorporated platform 210. Similarly, left device holder 2 is designed to rigidly hold a left hand device 24 upon an incorporated platform 210. Devices 23 and 24 may beneficially comprise an array/pattern of sensors/mechanical switches which are contact, pressure or otherwise actuated. These sensors/switches may be optimally positioned (and, conceivably, adjustably positioned by methods known in the art) so that the sensors may be selectively actuated by digit ends (finger tips) of a fully supported user. Improved ergonomic design is achieved by combining previously discussed relaxed support of the user's back, upper arms and forearms with critical support of the user's hands (significantly, the hand heel and, additionally, the palm), with design emphasis placed upon the maintenance of a substantially straight and relaxed wrist joint. Further benefit may be achieved by maintaining the supported user's wrist elevated with respect to the supported user's elbow. To accommodate all sized/shaped users, hand heel rest 21, and palm rest 22 should be adjustable, at least in height, using mechanical couplings known in the art. Hand heel rest 21 and palm rest 22 may also be cushioned for comfort. As described in detail below, device holder(s) 2 may also comprise thumb rests 28 to alleviate bothersome problems associated with the carpometacarpal joint at the base of the thumb. Thumb rest 28 may be adjustable and/or cushioned.

As previously stated, it is foundational that in all of the ergonomic chair and system embodiments presented herein the weight of a user's arms should be fully supported while typing or performing other tasks while seated and/or reclined in chair 100. Furthermore, it is logical that, given evidence related to repetitive strain and stress injuries to the hand, support of at least the heel of the user's hand while performing tasks, particularly such tasks requiring significant finger/ thumb motion, is also important. Referring to the familiar task of touch typing on essentially planar keyboards, actuation of the keys is commonly accomplished by interphalangeal flexion of the fingers/thumb while the user's wrist is maintained in position. There have been various attempts to arrange/align the keys of a standard typing keyboard assembly in a somewhat non-planar fashion to provide improved ergonomic designs. What is presented below is a keyboard design system, compatible with chair 100, to provide a substantial improvement. In summary, a touch typing keyboard is split into left hand and right hand segments. Next, the keys/actuators are disposed upon a multidimensionally arcuate surface such that many of the rows of keys may be comfortably actuated by interphalangeal flexion and/or extension, with hand heel and arm totally supported. Other rows of keys are aligned so that the keys are comfortably actuatable with a modest reach or stretch of the fingers/forearm while maintaining sufficient arm support and while minimizing anatomic stress and strain.

The devices to be held on platform(s) 210 of left and or right device holder(s) 2 may facilitate user performance of a wide variety of applications including, but not limited to, data input, typing, computer interfacing, and electronic gaming. Generic devices, it is to be understood, attachable to device holders 2 of chair 100, may include all instrumentation that may be operated by a user while the user's ergonomic position has been optimized by the aforementioned supporting structures of chair 100. While an objective is to offer a synergistic, ergonomic solution that neither requires learning new skills nor requires discarding skills already mastered, the specific left and right hand split keyboard devices of a standard QWERTY variety are in no way limiting with regard to the types of left 24 and right 23 devices to be considered within the scope and spirit of this disclosure.

Figure 4A:
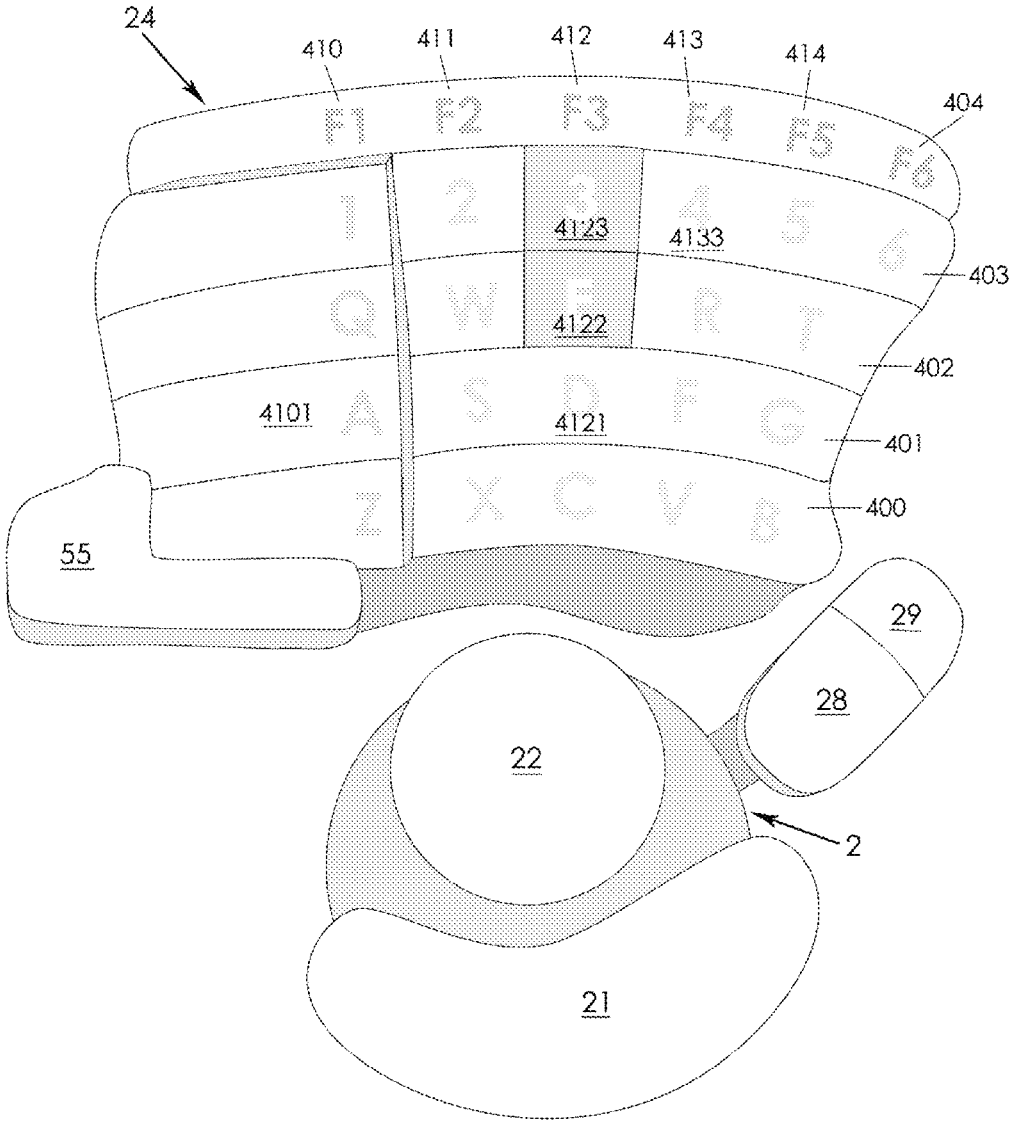
FIGS. 4(*a*) and 4(*b*) are aerial views of a first (left hand) device and a second (right hand) device respectively in accordance with an embodiment.
Figure 4B:
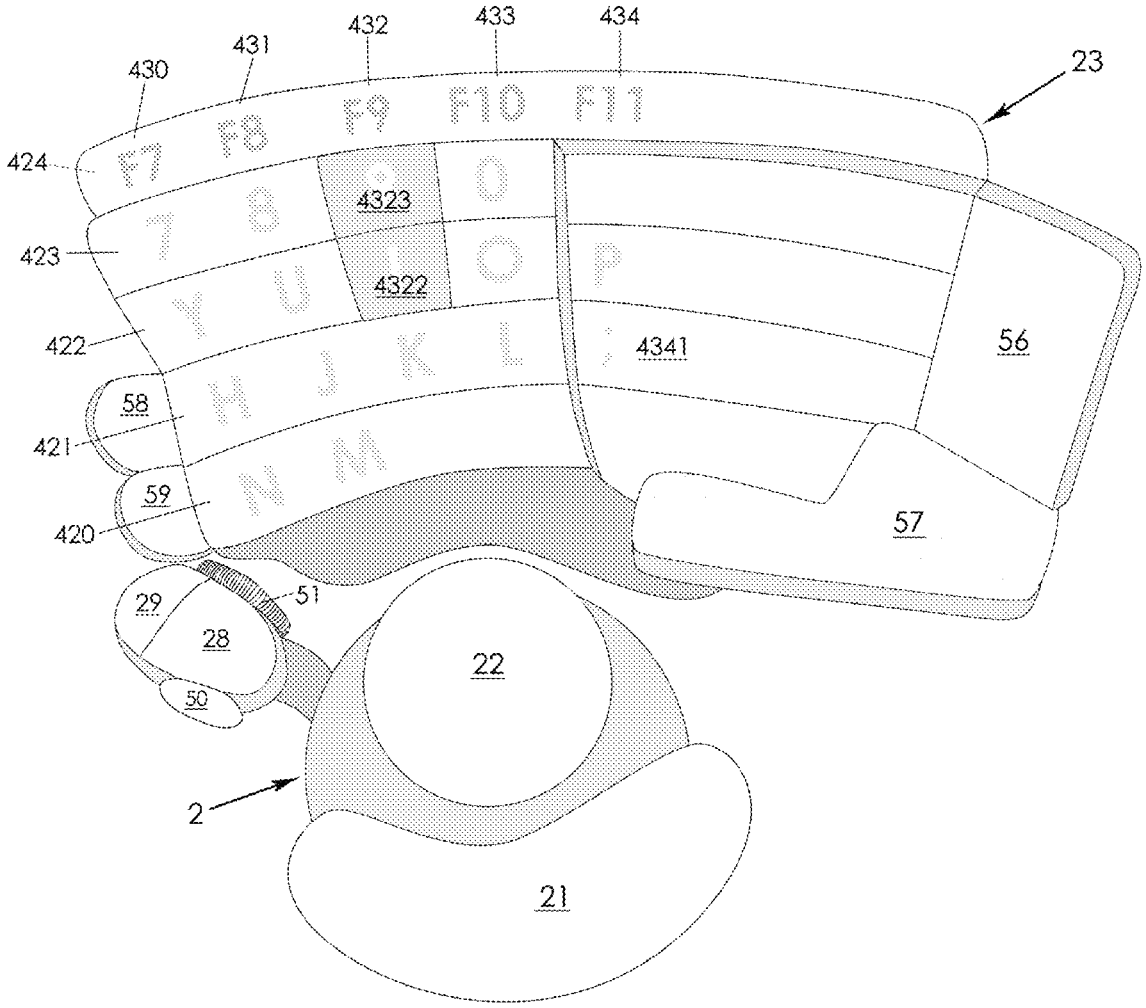

Define the fingers of the hand as (with increasing distance from the thumb) index, long, ring, and short. A QWERTY pattern of five rows as follows: define four rows of keys (from top to bottom, measured with decreasing distance from the surface upon which chair 100 sits) as F-key (or "function"), "number", "above home", and "home", with the fifth row of "below home" ascending upward. Refer to FIGS. 4(*a*) and (*b*) as well as FIGS. 5(*a*) and (*b*). Left 24 and right 23 data input devices that are attachable to device holders 2 are illustrated. Hand heel rest(s) 21 and palm rest(s) 22 support the hand(s) of the user so that the digit ends (defined herein as being fingers and thumb between the tip and the first joint) may, when the digits are in interphalangeal flexion or extension, comfortably, with only necessary reach/stretch, control actuation of the keys/sensors of devices 23 and 24. As in standard touch typing, the most natural position for the digit ends of the user will be at rest, in contact with the home row 401/421. Further, the natural start position laterally for the four fingers will be, for left device 24, at columns 410,411,412,413 (ASDF) and for right device 23, at columns 431,432,433,434 (JKL). Left 24 and right 23 data input devices are designed to minimize the stress placed on the digits in trying to reach and actuate the keys/sensors.

A supported user of chair 100 performs tasks using the keyboard design system, described in detail below, in the following manner. When supported user hand(s) is/are positioned on hand heel rest(s) 21 and (while optional, shown herein) palm rest(s) 22, the user's fingers naturally flex or bend over. The cascading of relaxed flexion of the fingers allows them to come to a natural resting place on the "home" row 401/421. This finger position is reminiscent of the resting place of touch typists operating a standard planar keyboard. Movement to actuate the "below home" row 400/420 actuators is a continued curl of individual fingers, bending them inward and upward (an act of increased flexion). Conversely, when fingers return to home row 401/421, the user uncurls the fingers (an act of relatively increased extension.) With continued uncurling motion, the individual fingers come into contact with the "above home" row 402/422 of actuators. Even further extension brings the fingers comfortably in contact with the "number" row 403/423 of keys. No matter what the orientation of the supported user's arms with respect to the surface upon which chair 100 rests (incline, recline or upright), the user's fingers are flexed to some degree. Alignment of the keys/sensors of "below home" 400/420 relative to the alignment of "home" 401/421 is at an obtuse angle from the bottom edge of home row keys. Alignment of the keys/sensors of "above home" 402/422 relative to the alignment of "home" 401/421 is at an obtuse angle from the top edge of home row keys. Alignment of the keys/sensors of "number" 403/423 relative to the alignment of "above home" 402/422 is at an obtuse angle from the top edge of "above home" row keys. Actuation of keys/sensors described above may comfortably occur while the hands of the user are supported. The "function" 404/424 row may be difficult for a user to reach if, traditionally, the keys/sensors are located further from "home" than are the keys/sensors of "number." As this keyboard system is non-planar, the embodiment illustrated in the figures features the keys/sensors of "function" rows 404/424 actuatable by, essentially, resting the fingers above and exerting force "downward" upon the top edge of the "number" keys/sensors. It is believed that, depending upon the size/shape of the user's hand(s), "function" keys may be actuated while the hand remains positioned upon hand heel rest 21 yielding an improved ergonomic result. Placing the keys/sensors on a surface that is multidimensionally arcuate facilitates this result. A "space bar" 29, a ball-type mouse 50, and a cursor scroll 51 could be incorporated on the keypads or, as depicted in FIG. 4(*a*), with the use of thumb rests 28 (in this instance, space bar 29 is shown incorporated in a portion of left thumb rest 28 of left device 24, while ball-type mouse 50 and cursor scroll 51 are incorporated into right thumb rest 28 of right device 23. In harmony with mouse 50 and cursor scroll 51, areas 58 and 59 may be used as "left click" and "right click" actuation sites. For a left-handed user, the position of some of these controls might be reversed.

Additional features of the illustrated data entry devices include, but are not limited to:

1. specific key/sensor actuators have been raised with respect to a row or column;
2. some actuators have been recessed with respect to a particular row or column;
3. the surface on which the key/sensor actuators are disposed is multidimensionally arcuate; and
4. direction of actuating force for keys/sensors disposed on specific rows differs from actuating force direction on keys/sensors disposed on other rows. This difference is measurable by the relative degree of flexion, extension and reach of user digits.

Figure 5A:
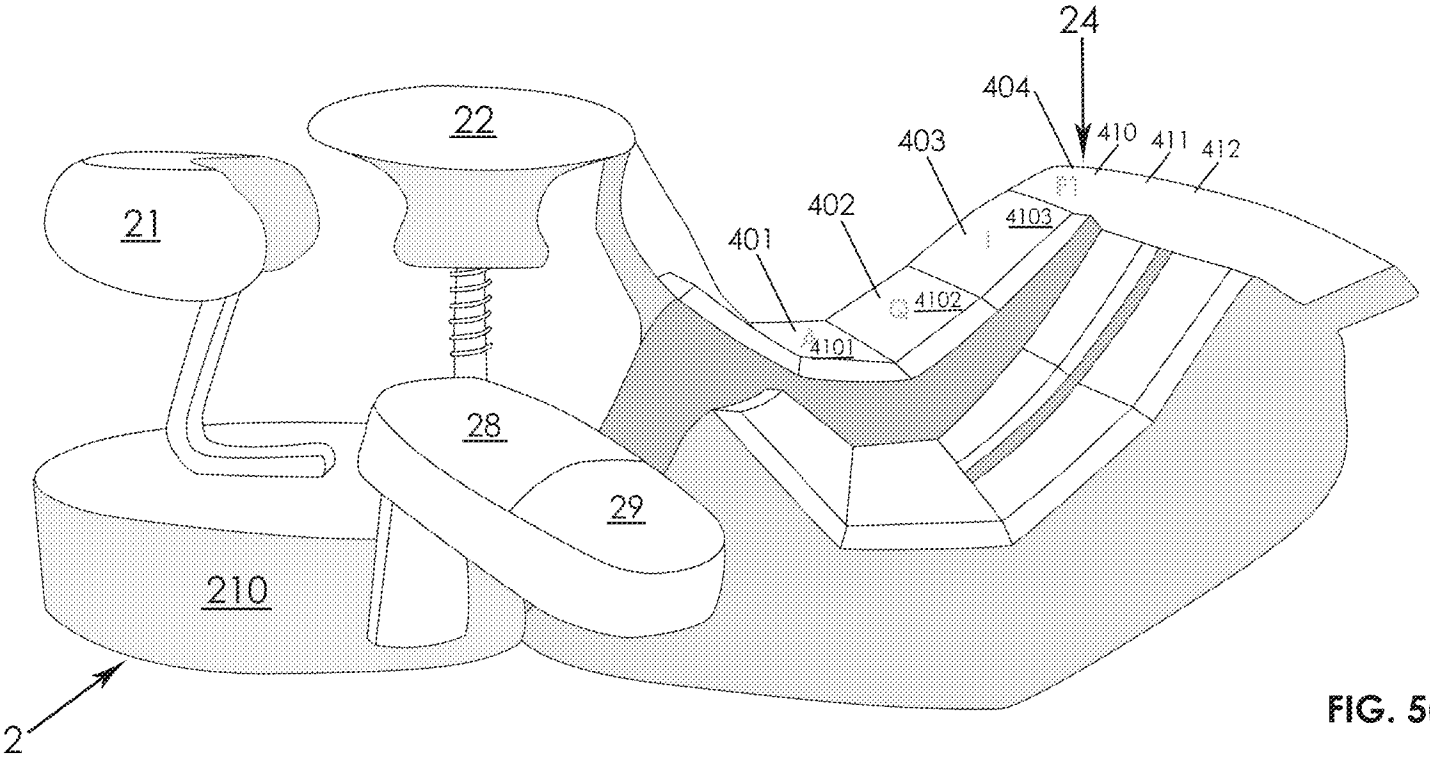
FIGS. 5(*a*) and 5(*b*) are perspective views of a first (left hand) device and a second (right hand) device respectively in accordance with an embodiment.
Figure 5B:
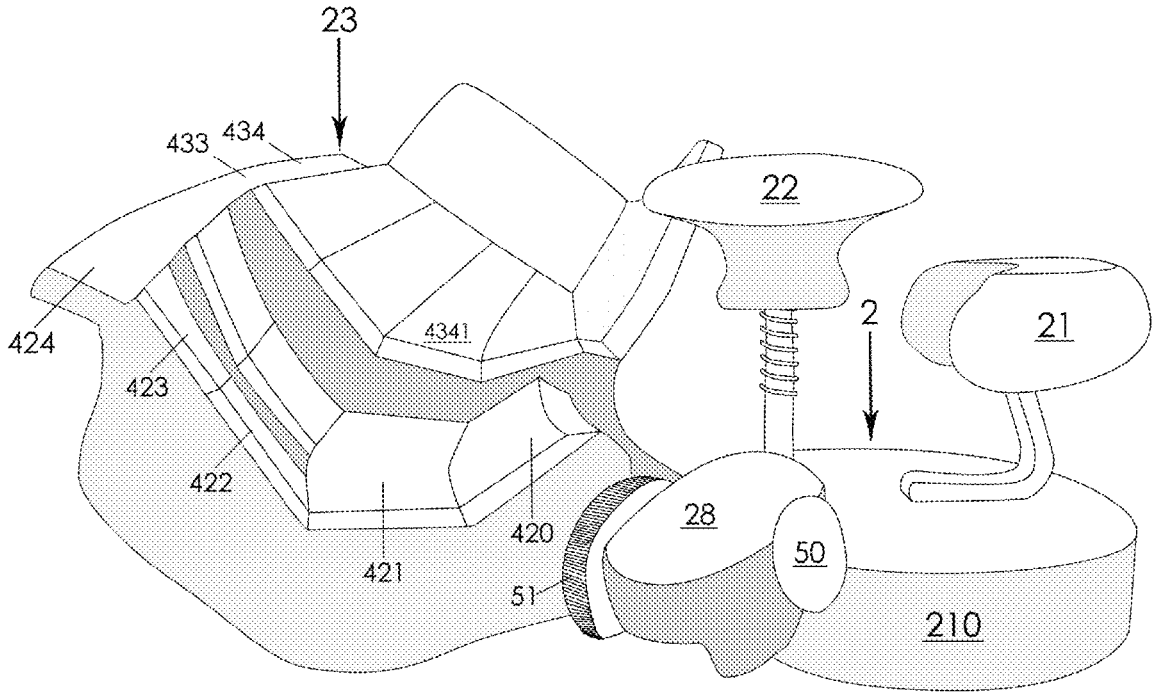

Featured recessed actuators tend to be those operated, using standard touch typing schema, by a long finger. On left device 24, actuators 4122 and 4123 (the letter E and the number 3) are more comfortably engaged (less or no bending of the knuckle) and actuated if they are recessed relative to the actuator 4121 (home row letter D) as well as recessed relative to the other immediately surrounding keys. Note that actuator 4133 (the number 4) may also be beneficially recessed. Similarly, on right device 23, actuators 4322 and 4323 (the letter I and the number 9) are preferably recessed. Featured raised actuators tend to be those operated by a short finger. On left device 24, all actuators situated to the left of column 411 have been raised relative to the actuators located on column 411. Refer to FIG. 5(*a*). Similarly, on right device 23, all actuators situated to the right of column 433, have been raised relative to the actuators located on column 433. Refer to FIG. 5(*b*). Thus, when the fingers are resting on "home," short fingers resting at 4101 (the letter A) and at 4341 (semi-colon) are more comfortably positioned. Further, keyboard areas 55, 56, and 57, where other auxiliary keys may be located and where short fingers perform the actuation, are shown to be spatially oriented to minimize stress on the short finger(s) of the supported user's hand(s).

Since chair 100 is ergonomically designed, a major remaining potential source of stress and strain resides in the finger joints when reaching to contact and actuate the keys/sensors of devices 23 and 24. It is thought that the hand heel rest(s) 21, because they help to support the weight of the hand under the carpal bones, allow sufficient freedom of movement of the hand and fingers to comfortably reach all of the actuators. The illustrated arcuate, physical keyboard embodiments are designed to minimize this stress and strain on the finger joints. It is to be understood that, with the development of advanced technology (particularly in the area of cellular and smartphone keyboards), keyboards within the scope of this disclosure may include incorporated actuators that change/alter/switch the functionality of rows, columns and/or individual keys/sensors.

Figure 6A:
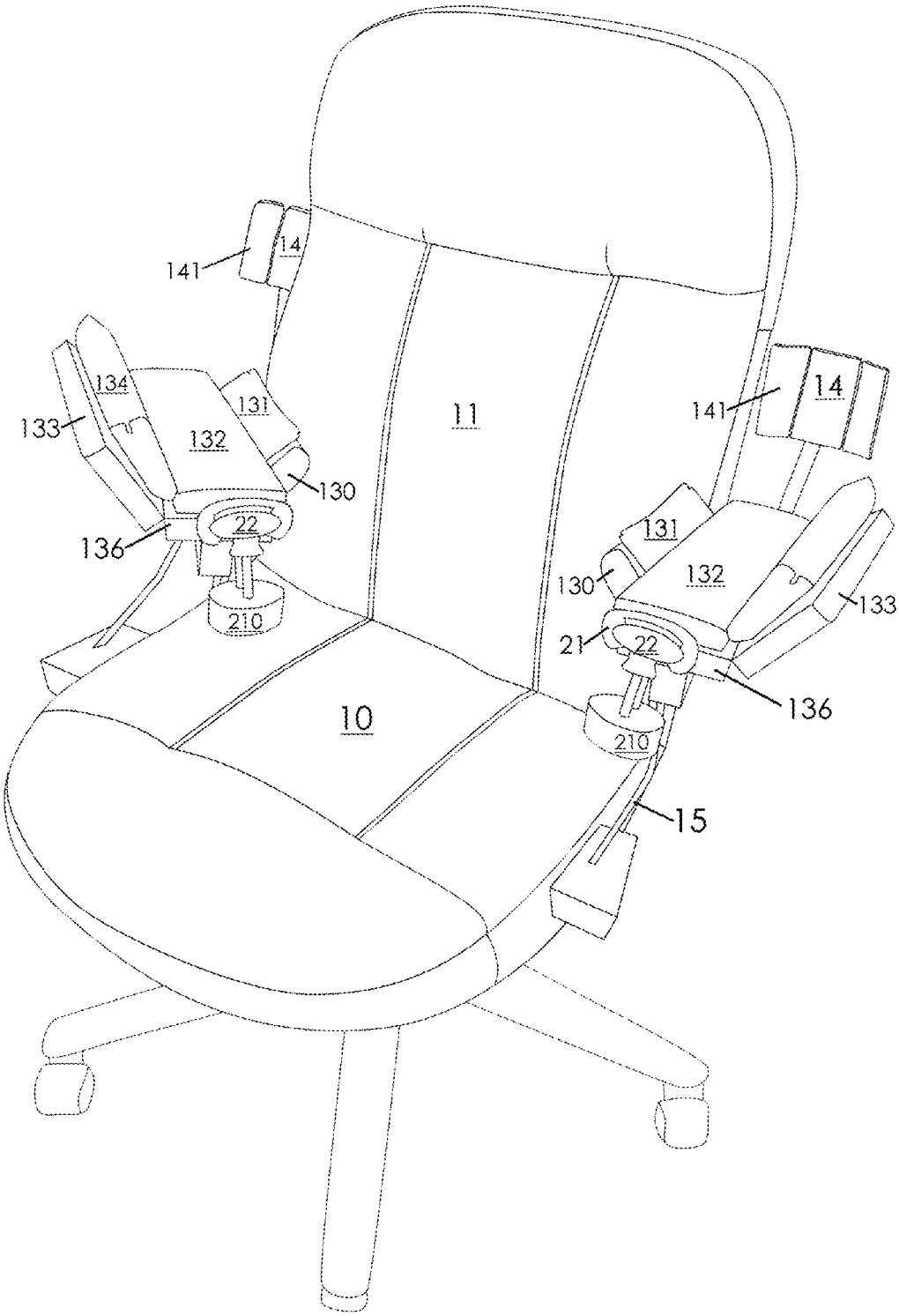
FIGS. 6(*a*) and 6(*b*) depicts an ergonomic chair or system with pivotal arm supports that rotate inward towards the torso of a user.
Figure 6B:
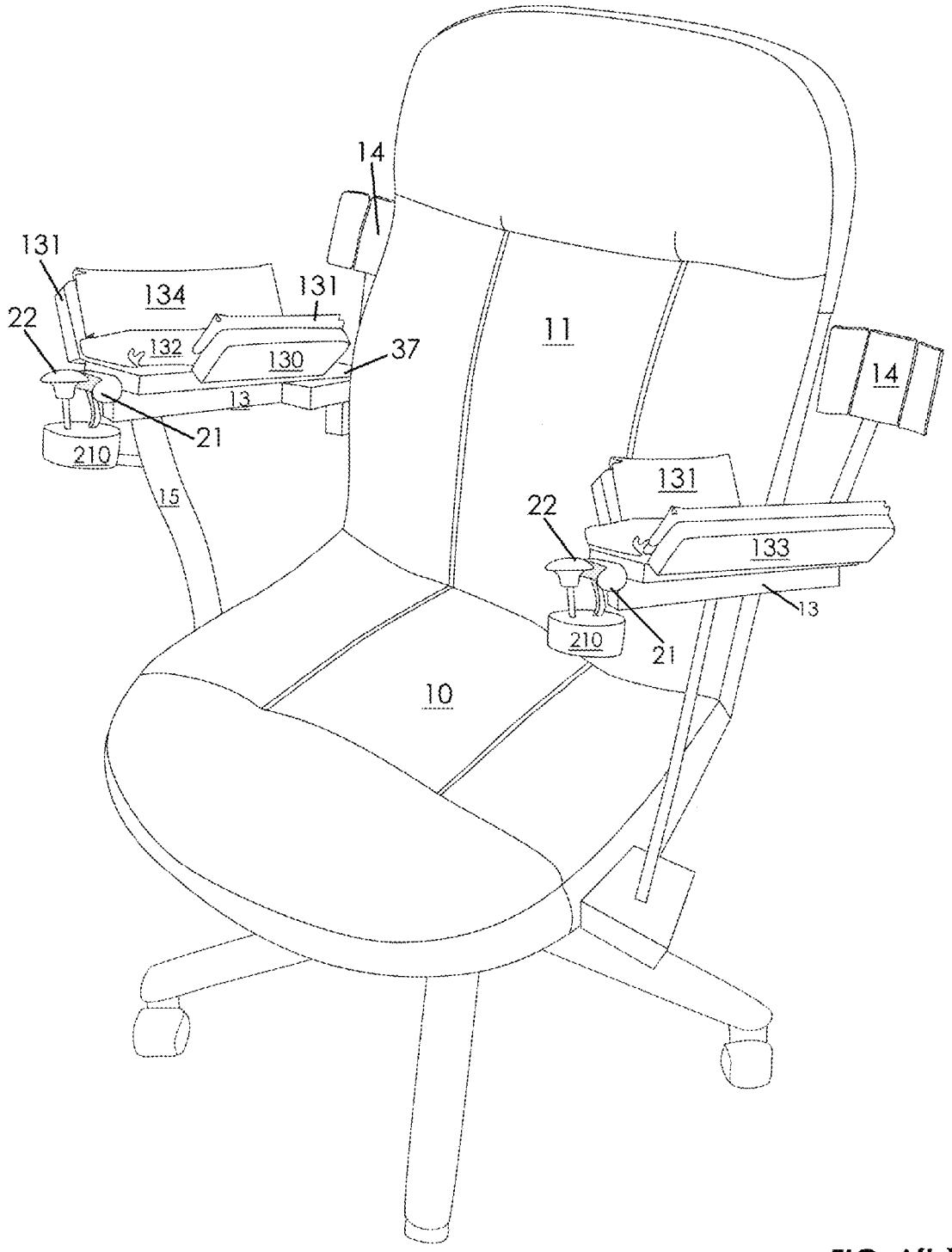

Refer to FIGS. 6(*a*) and 6(*b*). The associated forearm support structures may beneficially be rotatable/pivotal so as to be positionable inwardly, at a significantly large angle from a standard armchair alignment, toward a user's seated torso. Mechanisms to provide this additional feature to described ergonomic chairs and systems may include, but are in no way limited to, so-called lock and release type pivots (not shown) mountable on, for example, the underside of forearm base 13 and/or brace 15.

Figure 7:
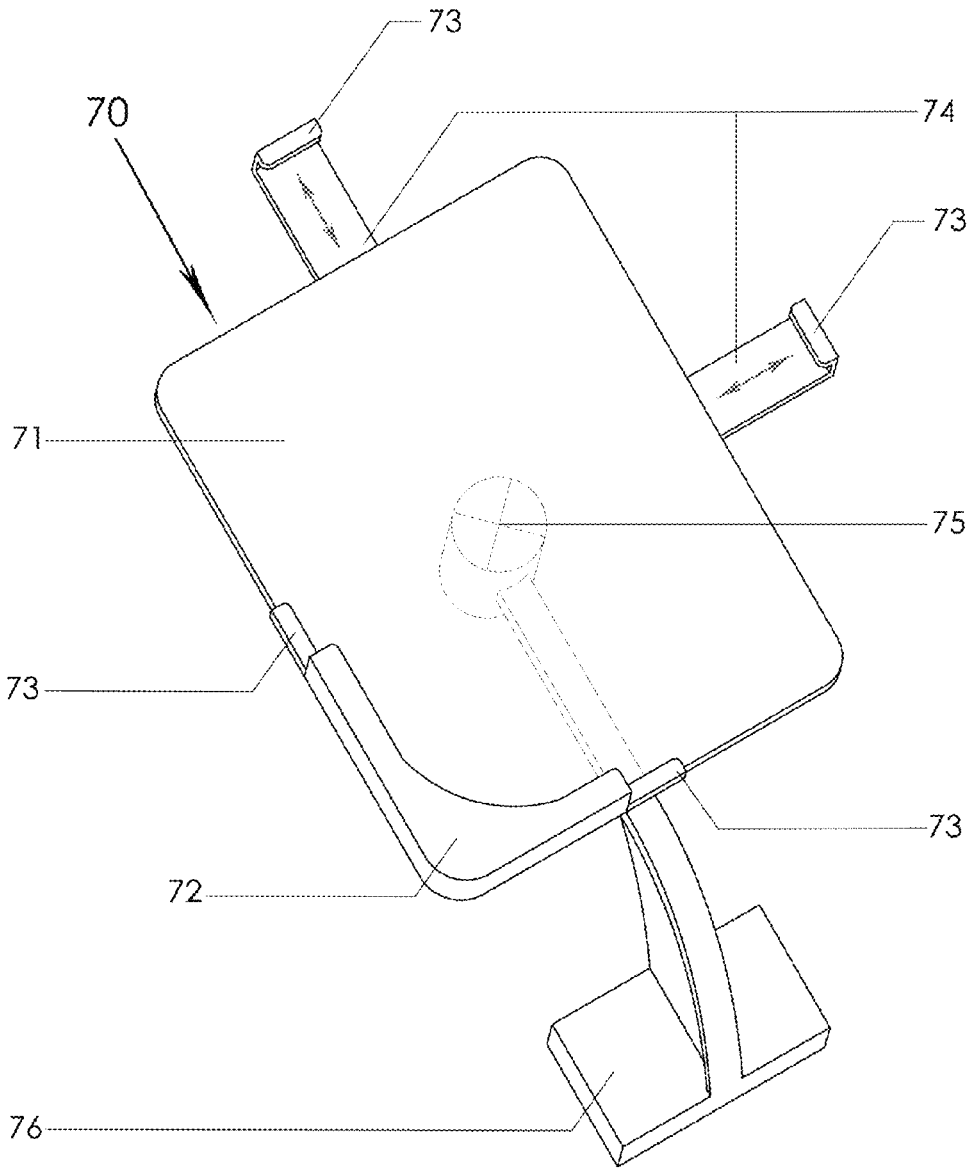
FIG. 7 is an aerial view of a device holder designed to hold a tablet or mobile device in an embodiment.

FIG. 7 illustrates a device holder 70 designed to hold a tablet or mobile device. Holder 70 is capable of supporting the weight of a computer tablet, game, or other mobile device. A user places the mobile device between holder back 71, which, as shown, has an approximate dimension of 4.25 inches high by 3.25 inches wide, and holder lip 72, having an approximate width of 0.5 inches. Located on each of the four sides of holder 70 are clamps 73. Some or all of the clamps 73 (four are shown) are used to secure a device to holder 70. As shown (but in no way limiting), two of the clamps 73 have an adjustable clamp length 74. Holder 70 has a base 76 and a ball and socket type pivot 75 disposed on holder back 71 to facilitate provision of and adjustment of device viewing and device orientation. Base 76 is attachable to platform 210 or device holder 2 (either left or right side) by means known to those of skill in the art.

Although the invention has been described with reference to several exemplary embodiments, it will be understood by one of ordinary skill in the art that various modifications can be made without departing from the spirit and the scope of the invention, as set forth in the claims.

What is claimed is:

1. An ergonomic chair for supporting a user, the chair comprising:

a seat having a top surface;

a back support coupled to the seat; and first and second forearm supports coupled to at least one of the seat and the back support, each of the first and second forearm supports comprising:

a forearm rest having a top surface, a front end, a rear end and opposing lateral side edges; and first and second sides coupled to the opposing lateral side edges of the forearm rest, each of the first and second sides being adapted to pivot relative to the forearm rest to accommodate variable forearm girth;

wherein the top surface of the forearm rest for each of the first and second forearm supports extends at an acute, non-parallel angle relative to the top surface of the seat in the direction from the rear end of the forearm rest to the front end of the forearm rest.

2. The ergonomic chair of claim 1 further comprising:

a first upper arm support to be positioned above a first elbow of the user, the first upper arm support being spaced apart from and connected to the first forearm support; and a second upper arm support to be positioned above a second elbow of the user, the second upper arm support being spaced apart from and connected to the second forearm support.

3. The ergonomic chair of claim 2 further comprising:

a first device holder coupled to at least one of the seat and the first forearm rest, the first device holder being independently adjustable with respect to a position relative to the first forearm support;

a second device holder coupled to at least one of the seat and the second forearm rest, the second device holder being independently adjustable with respect to a position relative to the second forearm support.

4. The ergonomic chair of claim 3 wherein each of the first and second device holders comprises:

a platform with a flat top surface and front end;

a hand heel rest that is spaced apart from and connected to the top surface of the platform, the hand heel rest having a flat top surface; and a palm rest that is spaced apart from and connected to the platform, the palm rest being spaced away from the hand heel rest and including a convex distal surface;

wherein the front end of the platform is adapted to be attached to a device.

5. The ergonomic chair of claim 4 wherein the device holder further comprises:

a thumb rest that is connected to the platform.

6. The chair of claim 5 wherein the thumb rest further comprises:

an actuator in electronic communication with an electronic device coupled to the device holder.

7. The ergonomic chair of claim 4 wherein the device comprises alphanumeric actuators disposed in rows that define a QWERTY pattern.

8. The ergonomic chair of claim 7 wherein the alphanumeric actuators comprise a first actuator and a second actuator in a common row, the first actuator being recessed with respect to the second actuator.

9. The ergonomic chair of claim 7, wherein a surface on which the alphanumeric actuators are disposed is multidimensionally concave.

10. The ergonomic chair system of claim 4 wherein the device is a holder adapted to support one of a tablet and a mobile device.

11. The ergonomic chair of claim 1 further comprising:

a frame, the frame capable of coupling the seat to the back support.

12. An ergonomic support structure adapted to be attached to a chair, the chair comprising a seat and a back support coupled together, the seat having a top surface, the support structure capable of supporting a forearm of a user with the user seated in the chair, the support structure comprising:

a forearm rest having a top surface, a front end, a rear end and opposing lateral side edges; and first and second sides coupled to the opposing lateral side edges of the forearm rest, each of the first and second sides being adapted to pivot relative to the forearm rest to accommodate variable forearm girth;

wherein the top surface of the forearm rest for each of the first and second forearm supports extends at an acute, non-parallel angle relative to the top surface of the seat in the direction from the rear end of the forearm rest to the front end of the forearm rest.

* * * * *